US006450622B1

(12) United States Patent
Nguyen et al.

(10) Patent No.: US 6,450,622 B1
(45) Date of Patent: Sep. 17, 2002

(54) FLUID EJECTION DEVICE

(75) Inventors: Tri Nguyen, Beaverton; Tim R Koch, Corvallis, both of OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/895,992

(22) Filed: Jun. 28, 2001

(51) Int. Cl.[7] ..... B41J 2/05
(52) U.S. Cl. ..... 347/63; 347/64
(58) Field of Search ..... 347/63, 64, 65, 347/20, 56, 61

(56) References Cited

U.S. PATENT DOCUMENTS 4,535,343 A * 8/1985 Wright et al. ..... 347/63
5,008,689 A * 4/1991 Pan et al. ..... 347/63
5,187,500 A * 2/1993 Bohorquez et al. ..... 347/63
5,682,188 A * 10/1997 Meyer et al. ..... 347/61
5,883,640 A * 3/1999 Figueredo et al. ..... 347/62
6,153,114 A 11/2000 Figueredo et al. ..... 216/27
6,155,674 A 12/2000 Figueredo et al. ..... 347/63
6,209,991 B1 4/2001 Regan et al. ..... 347/63
6,286,939 B1 9/2001 Hindman et al. ..... 347/63

* cited by examiner

*Primary Examiner*—John Barlow
*Assistant Examiner*—Juanita Stephen

(57) ABSTRACT

A fluid ejection device includes a substrate with a fluid drop generator, wherein the fluid drop generator is top coated with a first barrier layer. The device also has a second barrier layer substantially defining a chamber about the fluid drop generator, and at least one layer deposited in between the first and second barrier layers.

45 Claims, 4 Drawing Sheets

FLUID EJECTION DEVICE

BACKGROUND

Bubble jet printing, also known as thermal ink jet printing, is often accomplished by heating fluid in a firing chamber. Typically, there are many firing chambers situated upon a semiconductor chip. The heated ink in each firing chamber forms a bubble. Formation of the bubble forces the heated ink out of a nozzle or orifice associated with the firing chamber towards a medium in a thermal ink jet printing operation. One common configuration of a thermal ink jet printhead is often called a roof shooter-type thermal ink jet printhead because the ink drop is ejected in a direction perpendicular to the plane of the thin films and substrate that comprise the semiconductor chip.

Often, a resistor on the die heats the fluid in the firing chamber. The resistor is typically heated by electrical resistance heating. Electrical contacts are formed over the die and electrically coupled with conductor traces that coordinate pulsed delivery of electrical power to the resistor for a predetermined time. The electrical contacts are often formed of gold.

The material that defines the firing chamber is often organic. This organic material is typically deposited over a cavitation barrier layer, that is typically over a passivation layer over the resistor. In some instances, the organic material does not adhere to or becomes detached from the thin film layers over the die. For instance, repeated impact from the collapsing numerous bubbles can cause the organic material to become detached. When cracks are present in the thin film layers beneath, the electrically conductive ink can flow through the cracks or breaks and open up a passageway therebeneath. When the ink contacts underlying electrically conductive layers, the ink will corrode the conductive layers, resulting in increased resistance and eventual resistor failure. In severe cases an entire power supply bus may be corroded resulting in several resistors on a printhead failing. Accordingly, it is desired to protect the conductor traces from ink corrosion and to provide good adhesion of the material forming the firing chamber.

Additionally, gold often does not adhere well to some materials. In particular, gold often does not adhere well to the material forming the firing chamber. Therefore, it is desirable to identify materials that adhere well to gold, as well as the material forming the firing chamber.

SUMMARY

In one embodiment, a fluid ejection device includes a substrate with a fluid drop generator, wherein the fluid drop generator is top coated with a first barrier layer. The device also has a second barrier layer substantially defining a chamber about the fluid drop generator, and at least one layer deposited in between the first and second barrier layers.

These and other features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof that are illustrated in the appended drawings. The same numbers are used throughout the drawings to reference like features and components. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION

Figure 1:
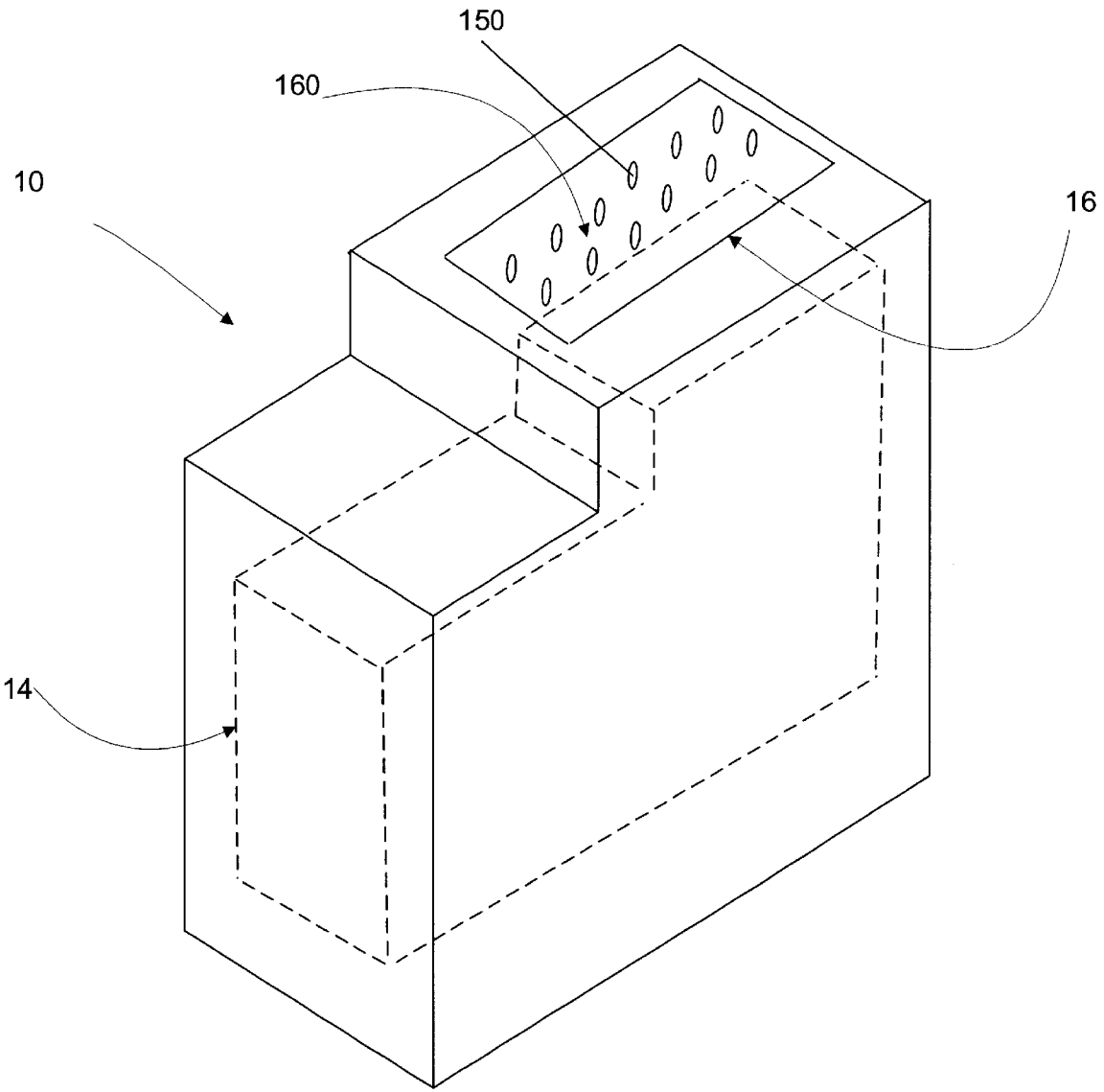
FIG. 1 is a perspective view of an embodiment of a print cartridge having a printhead in the present invention.

FIG. 1 illustrates a print cartridge 10 of the present invention. A printhead 16 is a component of the print cartridge 10 and is seen on a surface thereof. A fluid reservoir 14, depicted in phantom within print cartridge 10 in FIG. 1, contains a fluid that is supplied to printhead 16. A plurality of nozzles 150 on printhead 16, are also seen in FIG. 1. In one embodiment, the nozzles 150 are in orifice plate 160.

Figure 2:
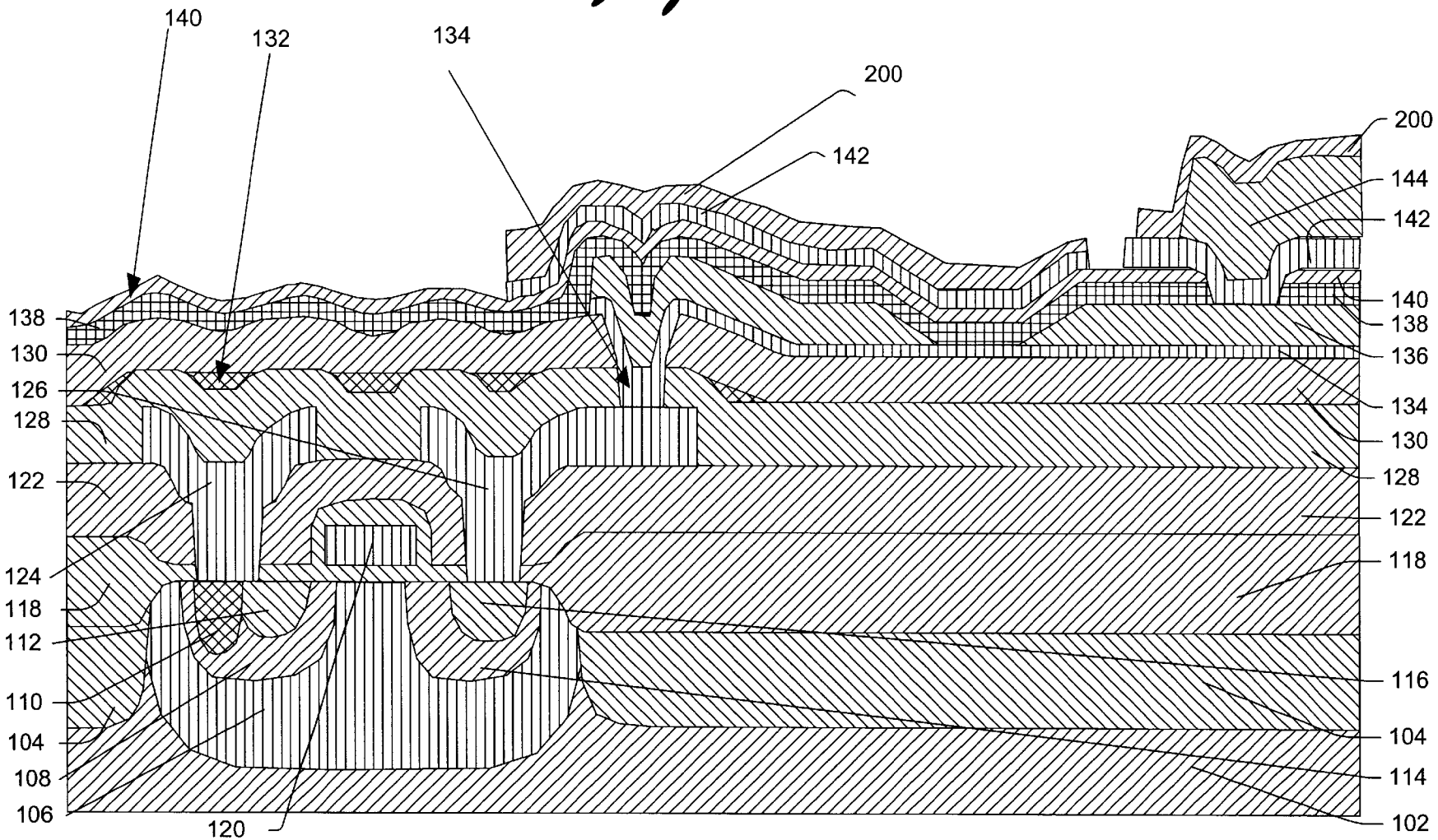
FIG. 2 is a partial cross-sectional view of a printhead in a stage of fabrication in accordance with one embodiment of the invention.
Figure 3:
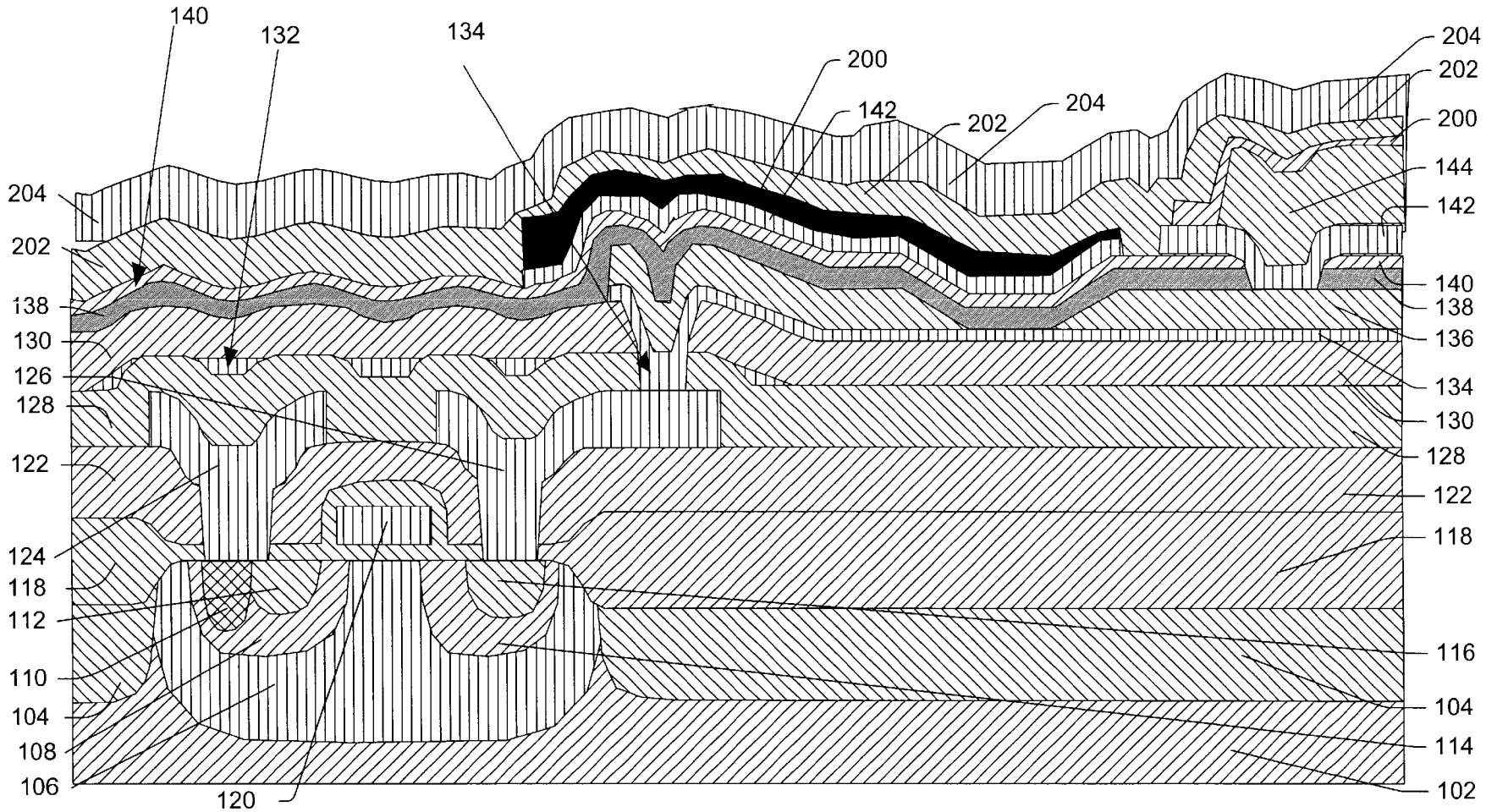
FIG. 3 is the view of the printhead seen in FIG. 2 after further processing in accordance with one embodiment of the invention.
Figure 4:
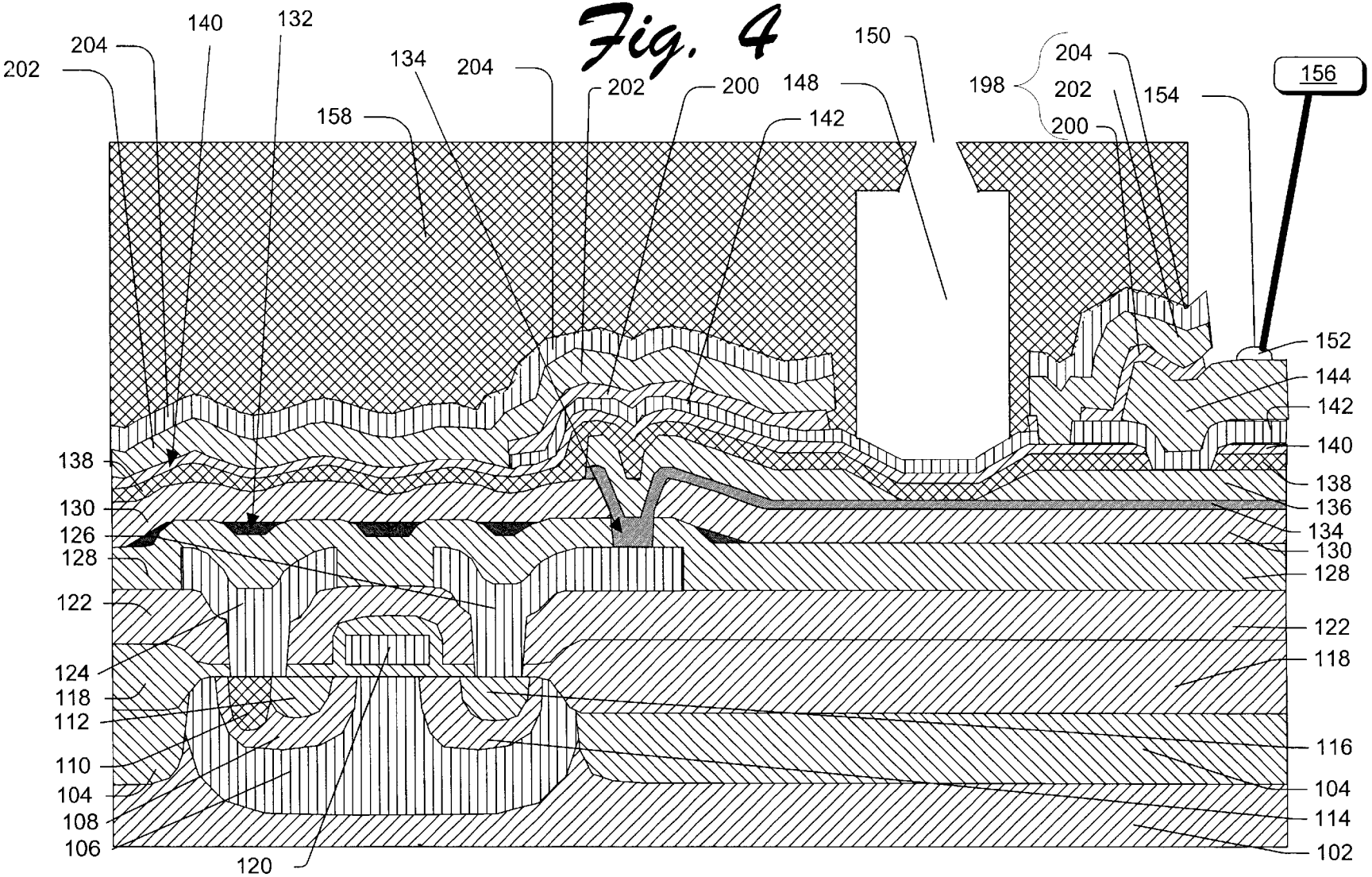
FIG. 4 is the view of the printhead seen in FIG. 3 after further processing in accordance with one embodiment of the invention, and further illustrating the printhead being in communication with a printer through a lead that is attached to a bond pad on the printhead.

FIGS. 2 to 4 illustrate some of the processing steps in one of the embodiments of the present invention. A substrate 102 is coated with several thin film layers as shown in the drawings. In this embodiment, conductor traces are etched, resistors (heating elements) are formed, and passivation layers 138, 140, cavitation barrier layer 142, and electrical contact 144 are deposited and etched. In one embodiment, a barrier layer 158 that defines a firing chamber 148 is deposited over the structure. In one embodiment, between the cavitation barrier layer 142 and electrical contact 144, and the barrier layer 158 is at least one layer 198. In one embodiment the at least one layer 198 is an adhesive structure or an adhesive layer. The adhesive structure 198 adheres to the layer 142, electrical contact 144, as well as the layer 158. In another embodiment, the at least one layer 198 is at least one of a dielectric layer, a passivation layer, an electrical contact bonding layer, an organic bonding layer, an etch stop, a semiconductor, a carbon bonding interface, a moisture barrier, a die surface optimizer, and a refractory metal, as described in more detail below. In another embodiment the at least one layer 198 is at least one of titanium, nickel vanadium alloy, silicon nitride, and silicon carbide.

An initial illustration for presenting an example of an embodiment of the invention is seen in the partial cross-sectional view of the printhead undergoing fabrication up to the stage depicted in FIG. 2. The fabrication of the device illustrated has a substrate 102. In one embodiment, the substrate is a semiconductor. The term "semiconductor substrate" includes semiconductive material. The term is not limited to bulk semiconductive material, such as a silicon wafer, either alone or in assemblies comprising other materials thereon, and semiconductive material layers, either alone or in assemblies comprising other materials. The term "substrate" refers to any supporting structure including but not limited to the semiconductor substrates described above. A substrate may be made of silicon, glass, gallium arsenide, silicon on sapphire (SOS), epitaxial formations, germanium, germanium silicon, diamond, silicon on insulator (SOI)

material, selective implantation of oxygen (SIMOX) substrates, and/or like substrate materials. Preferably, the substrate is made of silicon, which is typically single crystalline.

In one embodiment, the semiconductor substrate 102 can have doping, such as a P doping. In the embodiment shown, a P-field 104 and an N-Well 106 are within semiconductor substrate 102. In the embodiment shown, a first active area has doped regions 108, 110, 112, and second active area has doped regions 114, 116. In the embodiment shown, a field oxide region 118 is over the first and second active areas, and a gate 120 is within field oxide region 118.

In the embodiment shown in FIG. 2, upon field oxide region 118 is a dielectric or insulator material that includes but is not limited to silicon dioxide ($SiO_2$), a nitride material including silicon nitride, tetraethylorthosilicate ($Si(OC_2H_5)_4$) (TEOS) based oxides, borophosphosilicate glass (BPSG), phosphosilicate glass (PSG), borosilicate glass (BSG), oxide-nitride-oxide (ONO), polyamide film, tantalum pentoxide ($Ta_2O_5$), plasma enhanced silicon nitride (P—SiNx), titanium oxide, oxynitride, germanium oxide, a spin on glass (SOG), any chemical vapor deposited (CVD) dielectric including a deposited oxide, and/or like dielectric materials. In one embodiment, a BPSG layer 122 is typically upon field oxide region 118.

In the embodiment shown in FIG. 2, first and second contact plugs 124, 126, also referred to as "Metal 1", extend through BPSG layer 122 and are typically composed of aluminum or aluminum alloyed with copper. There are three dielectric layers over BPSG layer 122, including a first oxide layer 128, a second oxide layer 130, and a spin on glass (SOG) layer 132. In one embodiment, first and second oxide layers 128, 130 are typically formed by decomposition of TEOS gas. In the fabrication of the thermal ink jet printhead seen in FIG. 2, a mask is used to form first and second contact plugs 124, 126. After formation of first and second contact plugs 124, 126, the mask is removed that was used to form the same, such as by ashing-off a photoresist layer used in photolithography. In the embodiment shown, first and second oxide layers 128, 130 are formed with SOG layer 132 sandwiched there between.

In the embodiment shown, a resistive material layer 134 makes contact with second contact plug 126 and second oxide layer 130. In one embodiment, the resistive material layer is composed of an alloy of tantalum and aluminum. A first metal or conductive layer 136, also referred to as "Metal 2" and typically composed of an aluminum-copper alloy, is deposited upon resistive layer 134. In one embodiment, the layer 136 is etched therethrough to expose the resistive material underneath—a resistor.

In the embodiment shown, a first insulator layer 138 is upon first metal layer 136 and a second insulator layer 140 is upon first insulator layer 138. In one embodiment, passivation or first and second insulators layers 138, 140 are typically composed of $Si_3N_4$ and SiC, respectively. In one embodiment, the resistor 134 is thermally isolated by dielectric materials, such as silicon carbide and silicon nitride.

In the embodiment shown, a first barrier or cavitation barrier layer 142, preferably composed of tantalum, is deposited upon second insulator layer 140. The tantalum is dry etched to form first barrier layer 142. In this embodiment, the electrical contact 144 is upon first barrier layer 142. In one embodiment, the electrical contact is a noble metal. In another embodiment, the noble metal is gold. In another embodiment, the noble metal is platinum. In one embodiment, the noble metal forms a gold contact, which is formed by masking gold and defining the contact. In another embodiment, the noble metal is a substantially pure metal. In another embodiment, the noble metal is substantially resilient or does not bond well with other materials, such as organic materials. In another embodiment, the noble metal has a high oxidation level.

In the embodiment shown in FIGS. 2 to 4, a second barrier layer 200 is deposited and patterned and etched over the electrical contact 144 and the cavitation barrier layer 142. The layer 200 is preferably composed of a refractory metal or alloy thereof. In one embodiment, the refractory metal is chromium, cobalt, molybdenum, platinum, tantalum, titanium, tungsten, zirconium, hafnium (Hf), vanadium (V), or combinations thereof. Additionally or alternatively, the refractory metal is a near-noble metal, such as nickel (Ni), palladium. (Pd), platinum (Pt), or combinations thereof. More preferably, second barrier layer 200 is composed of a nickel vanadium alloy. Most preferably, second barrier layer 200 is titanium. In one embodiment, the second barrier layer 200 has a thickness in a range from about 250 Angstroms to about 2000 Angstroms, and preferably about 500 Angstroms.

In the embodiment of having titanium deposited to form second barrier layer 200, the deposition is sequentially after a wet-etch process of the electrical contact, but before the patterning of first barrier layer 142. Second barrier layer 200 is masked and patterned, followed by an etch through both first and second barrier layers 142, 200 to the second insulator layer 140 in the two (2) locations illustrated in FIG. 2. In the first location, there is a recess in the layers 142 and 200 in between the resistor area and the electrical contact 144. In the second location, layers 142 and 200 are terminated over a terminal end of the resistive layer 134, on an opposite side of the resistor area.

In one embodiment, an etch through both first and second barrier layers 142, 200 is preferably a dry anisotropic etch. In one embodiment where first and second barrier layers 142, 200 comprise tantalum and titanium, respectively, the etch employs a recipe of five steps. First, about 500 Angstroms of second barrier layer 142 is etched. Next, the wafers are sputtered in pure Argon. This step is useful in removing Ta/Au intermetallics that are present on the surface of first barrier layer 142. Following the Argon sputtering step, the wafers are etched in pure $Cl_2$. Another etch follows in both Ar and $Cl_2$ that is selective to the Ta of first barrier layer 142 with respect to other layers. An Argon clean follows to eliminate a residue probably resulting from an interaction of the $Cl_2$ with the photoresist used in masking. After dry etching, the photoresist is stripped with a combination of an $O_2$ and $H_2O$ plasma in elevated temperatures.

In one embodiment, the at least one layer 198 is barrier layer 200. In another embodiment, layer 200 is an electrical contact bonding layer, and/or an etch stop as described below. In another embodiment, the layer 200 is a die surface optimizer.

FIG. 3 shows further processing of the structure shown in FIG. 2. In one embodiment (not shown), one of layers 202 and 204 are deposited. In the embodiment where layer 202 is deposited, the at least one layer 198 is the layer 202 that is deposited upon the two (2) exposed portions of second insulator layer 140 as well as upon exposed portions of second barrier layer 200. In one embodiment, the layer 202 is composed of a material that is substantially electrically insulative such as silicon dioxide, silicon nitride, or silicon carbide, and preferably is relatively undoped. In one embodiment, the layer 202 is a dielectric layer. In another embodiment, the layer 202 is silicon nitride. In another embodiment, the layer 202 is a passivation layer. In another embodiment, the layer 202 is a moisture barrier layer. In another embodiment, the layer 202 is a die surface optimizer.

In the embodiment where layer 204 is deposited, the at least one layer 198 is the layer 204. In one embodiment, the adhesion layer 204 is a carbon containing material. In one embodiment, the layer 204 is silicon carbide. In one embodiment, the layer 204 is an adhesive layer. In one embodiment, the layer 204 adheres to the barrier layer 158. In another embodiment, the layer 204 is an organic bonding layer. In another embodiment the layer 204 is a carbon bonding interface. In one embodiment, the barrier layer 158 is an organic material. It is believed that a molecular interaction between the organic materials of layer 158 and the carbon of the silicon carbide in adhesion layer 204 causes enhanced adhesion between the two layers. In this embodiment, the enhanced adhesion enables barrier layer 158 to resist separation from the wafer during fabrication of the die thereon and/or during operation of the printhead. In another embodiment, the layer 204 is a semiconductor. In another embodiment, the layer 204 is a die surface optimizer.

In an alternative embodiment, shown in FIGS. 3 and 4, both layers 202 and 204 are deposited on the structure, with layer 204 deposited upon dielectric layer 202. In one embodiment, the at least one layer 198 is the layers 202 and 204. In another embodiment, the layers 202 and 204 are the die surface optimizer. In another embodiment, the adhesive structure is the layers 202 and 204. In one embodiment, the adhesive structure adheres to the layer 142, electrical contact 144, as well as the layer 158. In another embodiment, the layers 202, 204 are at least one of a dielectric layer, a passivation layer, an electrical contact bonding layer, an organic bonding layer, a semiconductor, a carbon bonding interface, a moisture barrier, a die surface optimizer. In one embodiment, the inherent strength of the laminate formed by dielectric layer 202 and adhesion layer 204 provides mechanical protection, moisture barrier protection, and electrical insulation to the underlying thin layers.

In one embodiment, both dielectric layer 202 and adhesion layer 204 are composed of a carbon containing material, such as silicon carbide. Dielectric layer 202 and adhesion layer 204 are preferably deposited in a process such as chemical vapor deposition or a plasma enhancement (PECVD) thereof. Both layers are preferably deposited in situ and under vacuum. In one embodiment, dielectric layer 202 and adhesion layer 204 comprise silicon nitride and silicon carbide, respectively. In one embodiment, the silicon nitride is deposited by PECVD and has a thickness in the range of 2500 to 5000 Angstroms. In another embodiment, the thickness is about 4740 to 5000 Angstroms. In one embodiment, the silicon carbide is deposited by PECVD and has a thickness in the range of 1500 to 3500 Angstroms. In another embodiment, the thickness of silicon carbide is about 1000 to 2600 Angstroms. In another embodiment, the thickness of silicon carbide is about 2400 to 2500 Angstroms.

In one embodiment, there is no removal of organic chemical residue on the surface of the wafers prior to the deposition of dielectric layer 202 and adhesion layer 204. In one embodiment, after layer 204 is deposited as shown in FIG. 3, the adhesion layer 204 is patterned and subjected to two etches. The first etch, preferably a dry etch, etches through both adhesion layer 204 and dielectric layer 202 to stop on second barrier layer 200 in the area of the resistor and/or the electrical contact 144. In one embodiment, the dry etch uses $CF_4$ as the reactive gas and is heavily diluted in Argon. In the embodiment where the second barrier layer 200 is titanium, the layer 200 adheres well to gold and silicon nitride, and also serves as an etch stop layer for the dry etch through both adhesion layer 204 and dielectric layer 202.

FIG. 4 illustrates in part the results of one embodiment of a second etch, that etches through second barrier layer 200 to expose first barrier layer 142 in the area of the resistor, and a bottom surface of a firing chamber 148. In one embodiment, the second etch is a wet etch and the second barrier layer 200 comprises titanium. In one embodiment, the wet etch uses an etchant that is $H_2O$: $HNO_3$: HF in the ratio of about 200:43:1, because this etchant has a high selectivity ratio between titanium and tantalum materials.

In one embodiment, the layers 200, 202, and 204 are etched to expose the electrical contact 144. A bond pad 152 is attached to the electrical contact 144. The printhead 100 is coupled with a printer 156 through a lead 154 to bond pad 152. Bond pad 152 is attached to electrical contact 144 and lead 154 is attached to both bond pad 152 and printer 156.

In one embodiment, as shown in FIG. 4, a barrier layer 158 is deposited over the layer 204. The barrier layer 158 defines the firing chamber 148 adjacent the resistor area. The firing chamber 148 contains fluid to be heated by the resistor. When gate 20 signals resistor 134 for heating, the fluid in firing chamber 148 forms a vapor bubble. The vapor bubble then causes a quantity of ink to be ejected in a jet out of nozzle 150 at the top of firing chamber 148 and towards media that is to be printed upon. In essence, the firing chamber is used to fire a drop of fluid so as to create and then collapse a vapor bubble. The rapid expansion and contraction of the ink vapor pressure will create an impulse (dP/dt) that behaves like a mechanical impact on the resistor. In one embodiment, the cavitation barrier layer aids in preserving the resistor.

Generally, the barrier layer 158 has a thickness of up to about 20 microns. In another embodiment, the barrier layer 158 is comprised of a fast cross-linking polymer such as photoimagable epoxy (such as SU8 developed by IBM), photoimagable polymer or photosensitive silicone dielectrics, such as SINR-3010 manufactured by ShinEtsu™. In one embodiment, the polymer is masked and exposed to define the firing chamber. The polymer cross-links in the exposed areas. The unexposed areas are washed away, thereby forming the firing chamber.

The firing chamber has side walls and a bottom with a perimeter that couples with the side walls. In one embodiment, the side walls are formed by the barrier layer 158, and the bottom is formed by the cavitation barrier layer 142. In one embodiment, the barrier layer, together with the cavitation barrier layer, substantially encapsulates the at least one layer 198. As shown in the embodiment of FIG. 4, terminal ends of layers 200, 202, and 204, over layer 142, abut the barrier layer 158 forming the side walls of the firing chamber.

In one embodiment, the barrier layer 158 is an organic material. In another embodiment, the barrier layer is a polymer material. In another embodiment, the barrier layer 158 is made of an organic polymer plastic which is substantially inert to the corrosive action of ink. Plastic polymers suitable for this purpose include products sold under the trademarks VACREL and RISTON by E. I. DuPont de Nemours and Co. of Wilmington, Del. The barrier layer 158 has a thickness of about 20 to 30 microns. In another embodiment, an orifice layer is deposited over the barrier layer, such that the orifices are associated with the firing chambers formed by the barrier layer.

In one embodiment, fluid is a liquid. In one embodiment, the fluid is ink. In another embodiment, fluid is a gas. In another embodiment, fluid is a powder.

It should be recognized that in addition to the thermal inkjet embodiment described above, this invention lends itself to alternative digital printing and drop formation technologies including: electrophotography, dye sublimation, medical devices, impact printing, piezoelectric drop ejection, and flextensional drop ejection.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A fluid ejection device comprising at least one layer comprising a first refractory metal upon a layer of noble metal and sandwiched between a barrier layer substantially defining a firing chamber and a cavitation barrier layer comprising a second refractory metal.

2. The fluid ejection device of claim 1 wherein the layer of noble metal is an electrical contact through which electricity is supplied to the fluid ejection device.

3. The fluid ejection device of claim 1 wherein the barrier layer, together with the cavitation barrier layer, substantially encapsulates the at least one layer.

4. The fluid ejection device of claim 1 wherein the firing chamber has side walls and a bottom with a perimeter that couples with the side walls, wherein the side walls are formed by the barrier layer, and the bottom is formed by the cavitation barrier layer.

5. A fluid ejection device comprising:

a substrate with a thin film stack forming a heating element, wherein the heating element is coated with a cavitation barrier layer that is part of the thin film stack;

a barrier layer substantially defining a firing chamber about the heating element; and at least one layer deposited in between the thin film stack and the barrier layer, wherein the at least one layer includes an etch stop.

6. The fluid ejection device of claim 5 wherein the at least one layer includes an adhesive structure that adheres to at least one of the thin film stack and the barrier layer.

7. The fluid ejection device of claim 5 wherein the at least one layer includes an adhesive structure that adheres to an electrical contact in the thin film stack.

8. The fluid ejection device of claim 5 wherein the at least one layer includes an adhesive layer adhering to at least one of the thin film stack and the barrier layer that substantially defines the firing chamber.

9. The fluid ejection device of claim 5 wherein the at least one layer includes an adhesive layer adhering to an electrical contact in the thin film stack.

10. The fluid ejection device of claim 9 wherein the adhesive layer includes at least one of titanium and nickel vanadium alloy.

11. The fluid ejection device of claim 5 wherein the at least one layer includes a dielectric layer.

12. The fluid ejection device of claim 5 wherein the at least one layer includes silicon nitride.

13. The fluid ejection device of claim 5 wherein the at least one layer includes a passivation layer.

14. The fluid ejection device of claim 13 wherein the at least one layer includes an adhesive layer that adheres to an electrical contact in the thin film stack.

15. The fluid ejection device of claim 13 wherein the at least one layer includes an etch stop under the passivation layer.

16. The fluid ejection device of claim 5 wherein the etch stop adheres to an electrical contact in the thin film stack.

17. The fluid ejection device of claim 16 wherein the electrical contact comprises a noble metal.

18. The fluid ejection device of claim 5 wherein the etch stop includes at least one of titanium, and nickel vanadium alloy.

19. The fluid ejection device of claim 5 wherein the at least one layer includes silicon carbide.

20. A fluid ejection device comprising:

a substrate with a thin film stack forming a heating element, wherein the heating element is coated with a cavitation barrier layer that is part of the thin film stack;

a barrier layer substantially defining a firing chamber about the heating element; and at least one layer deposited in between the thin film stack and the barrier layer, wherein the at least one layer includes a refractory metal.

21. A fluid ejection device comprising:

a substrate with a thin film stack forming a heating element, wherein the heating element is coated with a cavitation barrier layer that is part of the thin film stack;

a barrier layer substantially defining a firing chamber about the heating element; and at least one layer deposited in between the thin film stack and the barrier layer, wherein the at least one layer includes a carbon bonding interface, wherein the barrier layer is organic and bonds to the carbon molecules in the carbon bonding interface.

22. A fluid ejection device comprising:

a substrate with a thin film stack forming a heating element, wherein the heating element is coated with a cavitation barrier layer that is part of the thin film stack;

a barrier layer substantially defining a firing chamber about the heating element; and at least one layer deposited in between the thin film stack and the barrier layer, wherein the at least one layer is an organic bonding layer, wherein the barrier layer is organic, and the organic bonding layer is silicon carbide, wherein the organic bonding layer and the barrier layer bond.

23. A fluid ejection device comprising:

a substrate with a thin film stack forming a heating element, wherein the heating element is coated with a cavitation barrier layer that is part of the thin film stack;

a barrier layer substantially defining a firing chamber about the heating element; and at least one layer deposited in between the thin film stack and the barrier layer, wherein the at least one layer includes a moisture barrier layer.

24. A fluid ejection device comprising:

a substrate with a thin film stack forming a heating element, wherein the heating element is coated with a cavitation barrier layer that is part of the thin film stack;

a barrier layer substantially defining a firing chamber about the heating element; and at least one layer deposited in between the thin film stack and the barrier layer, wherein the at least one layer is a die surface optimizer.

25. A print cartridge comprising a fluid ejection device having:

a substrate with a thin film stack forming a heating element, wherein the heating element is coated with a cavitation barrier layer that is part of the thin film stack;

a barrier layer substantially defining a firing chamber about the heating element; and at least one layer deposited in between the thin film stack and the barrier layer, wherein the at least one layer includes an etch stop.

26. The fluid ejection device of claim 25 wherein the at least one layer includes an adhesive structure that adheres to at least one of the thin film stack and the barrier layer.

27. The fluid ejection device of claim 25 wherein the at least one layer includes an adhesive structure that adheres to an electrical contact in the thin film stack.

28. The fluid ejection device of claim 25 wherein the at least one layer includes a dielectric layer.

29. The fluid ejection device of claim 25 wherein the at least one layer includes silicon nitride.

30. The fluid ejection device of claim 25 wherein the at least one layer includes silicon carbide.

31. The fluid ejection device of claim 25 wherein the at least one layer includes a passivation layer.

32. The fluid ejection device of claim 31 wherein the at least one layer includes an adhesive layer that adheres to an electrical contact in the thin film stack.

33. The fluid ejection device of claim 31 wherein the etch stop is under the passivation layer.

34. The fluid ejection device of claim 25 wherein the etch stop adheres to an electrical contact in the thin film stack.

35. The fluid ejection device of claim 34 wherein the electrical contact comprises a noble metal.

36. The fluid ejection device of claim 25 wherein the at least one layer includes at least one of titanium, and nickel vanadium alloy.

37. A print cartridge comprising a fluid ejection device having:

a substrate with a thin film stack forming a heating element, wherein the heating element is coated with a cavitation barrier layer that is part of the thin film stack;

a barrier layer substantially defining a firing chamber about the heating element; and at least one layer deposited in between the thin film stack and the barrier layer, wherein the at least one layer includes a carbon bonding interface, wherein the barrier layer is organic and bonds to the carbon molecules in the carbon bonding interface.

38. A print cartridge comprising a fluid ejection device having:

a substrate with a thin film stack forming a heating element, wherein the heating element is coated with a cavitation barrier layer that is part of the thin film stack;

a barrier layer substantially defining a firing chamber about the heating element; and at least one layer deposited in between the thin film stack and the barrier layer, wherein the at least one layer is an organic bonding layer, wherein the barrier layer is organic, and the organic bonding layer is silicon carbide, wherein the organic bonding layer and the barrier layer bond.

39. A print cartridge comprising a fluid ejection device having:

a substrate with a thin film stack forming a heating element, wherein the heating element is coated with a cavitation barrier layer that is part of the thin film stack;

a barrier layer substantially defining a firing chamber about the heating element; and at least one layer deposited in between the thin film stack and the barrier layer, wherein the at least one layer is a die surface optimizer.

40. A semiconductor device comprising:

a substrate having semiconductive properties;

a first layer comprising a material selected from the group consisting of tantalum and gold;

a second layer comprising a material selected from the group consisting of titanium and a nickel vanadium alloy deposited over the first layer; and a third layer comprising at least one material selected from the group consisting silicon nitride, silicon carbide and silicon oxide deposited over the second layer.

41. A semiconductor device comprising:

a substrate having semiconductive properties;

a first layer deposited over the substrate, wherein the first layer is an etch stop and defines a bottom of a chamber;

a second layer deposited over the first layer, wherein the second layer defines sides of the chamber; and a third layer encapsulated between the first and second layers.

42. A semiconductor device comprising:

a substrate having semiconductive properties;

a first refractory metal over the substrate;

a layer of a noble metal upon the first refractory metal; and a second refractory metal, different in composition than the first refractory metal, upon the layer of noble metal.

43. A fluid ejection device comprising:

a substrate with a fluid drop generator, wherein the fluid drop generator is top coated with a first barrier layer;

a second barrier layer substantially defining a chamber about the fluid drop generator and formed over the substrate; and at least one etch stop layer deposited in between the first and second barrier layers.

44. The fluid ejection device of claim 43 wherein the first and second barrier layers define the chamber.

45. A semiconductor device comprising:

a first refractory metal over a substrate;

a noble metal upon the first refractory metal; and a second refractory metal, different in composition than the first refractory metal, upon the noble metal.

* * * * *